US005988268A

United States Patent [19]

Usami et al.

[11] Patent Number: 5,988,268

[45] Date of Patent: Nov. 23, 1999

[54] PLATE TYPE HEAT EXCHANGER

[75] Inventors: Toshiya Usami, Osaka; Kenji Kusunoki, Higashiosaka, both of Japan

[73] Assignee: Hisaka Works Limited, Osaka, Japan

[21] Appl. No.: 08/732,350

[22] PCT Filed: Mar. 29, 1996

[86] PCT No.: PCT/JP96/00848

§ 371 Date: Nov. 4, 1996

§ 102(e) Date: Nov. 4, 1996

[87] PCT Pub. No.: WO96/30711

PCT Pub. Date: Oct. 3, 1996

[30] Foreign Application Priority Data

Mar. 29, 1995 [JP] Japan ..... 7-71955

[51] Int. Cl.[6] ..... F28F 3/10

[52] U.S. Cl. ..... 165/166; 165/167; 277/652

[58] Field of Search ..... 165/166, 167; 277/652

[56] References Cited

U.S. PATENT DOCUMENTS 2,580,546 1/1952 Hobson, Jr. ..... 277/652 X 3,322,433 5/1967 Rentschler ..... 277/652 X 4,915,355 4/1990 Fort ..... 277/652 X 5,178,212 1/1993 Nakamura ..... 165/166

*Primary Examiner*—Leonard Leo

*Attorney, Agent, or Firm*—Nikaido Marmelstein Murray & Oram LLP

[57] ABSTRACT

A plate type heat exchanger includes a plurality of laminated plates 11 each having a resin-covered gasket 15 mounted in a gasket groove 13 therein surrounding a heat transfer surface 12. The resin-covered gasket includes a core 15*a* of elastic material whose liquid-contacted side surface is covered with a corrosion-resistant resin cover 15*b*. In this plate type heat exchanger, the liquid-noncontacted side of the core 15*a* is integrally formed with a fixing element 16, while the outer peripheral surface of the plate 11 is formed with a recess 14 adapted to fit on the fixing element 16. Thus, the resin-covered gasket 15 can be mounted in the gasket groove 13 without using any adhesive agent.

1 Claim, 5 Drawing Sheets

PLATE TYPE HEAT EXCHANGER

TECHNICAL FIELD

The present invention relates to a plate type heat exchanger used in the food industry and pharmaceutical industry where in mounting plate type heat exchanger gaskets on the plates, the use of an adhesive agent, such as a synthetic rubber type adhesive agent or viscous tape should be avoided and in the general chemical industry where enhanced operability in the replacement and maintenance of gaskets is desired.

BACKGROUND ART

Generally, the plate type heat exchanger comprises a plurality of plates laminated through gaskets to form a plurality of passages defined between said plates, wherein two different fluids are passed through said passages to effect heat exchange between said fluids through the plates.

The plate 1 used in the plate type heat exchanger, as shown in FIG. 21, comprises a rectangular flat plate having a heat transmitting surface formed with a suitable uneven pattern (not shown), fluid passage holes 3 formed at the four corners, a gasket groove 4 formed in the periphery of the heat transmitting surface and in a region which surrounds the fluid passage holes 3, and a gasket 5 fitted in said gasket groove.

In this connection, in the case of a plate type heat exchanger handling organic solvents in the chemical and pharmaceutical industries, use is made of a resin-covered gasket 5, as shown in FIG. 22, which comprises an elastic core 5*a* of elastic material, such as synthetic rubber, whose side which comes in contact with the liquid is covered with a corrosion-resistant resin cover 5*b* of U-shaped cross section.

Conventionally, the mounting of said resin-covered gasket 5 on the plate 1 is effected by bonding it to the flat region of the gasket groove 4 by an adhesive agent 6, such as a synthetic rubber type adhesive agent or viscous tape.

However, if the resin-covered gasket 5 is mounted on the plate 1 by the adhesive agent 6, long-term use results in permeation of the organic solvent or the like into the bonded surface of the resin-covered gasket 5, dissolving and deteriorating the adhesive agent 6, mixing impurities into the liquid, leading to the disadvantage of lowering the quality of the treating liquid.

Further, if the sealing property lowers due to the dissolution and deterioration of the adhesive agent, the liquid seeps through the flat region of the gasket groove 4 into the core 5*a* which lacks resistant to corrosion, thus corroding and decomposing the core 5*a*, leading to another problem that the sealing property is further degraded.

Further, when the resin-covered gasket 5 is to have its cover renewed, it is necessary that in order to fully retain the sealing property, the old adhesive agent 6 adhering to the flat region of the gasket groove 4 be completely removed with the utmost care; thus, much labor is involved and the operating efficiency in maintenance is very low.

DISCLOSURE OF THE INVENTION

The present invention, which has been accomplished with the above problems in mind, is intended to provide a plate type heat exchanger wherein the resin-covered gasket can be mounted on the plate without using any adhesive agent.

To achieve the above object, the invention provides a plate type heat exchanger comprising a plurality of laminated plates each formed with a gasket groove surrounding the heat transfer surface with a gasket fitted therein, said gasket comprising a core of elastic material and a corrosion-resistant resin cover covering that side of the core surface which comes in contact with the liquid, said exchanger being characterized in that the opposite side, or liquid-noncontacted side, of said core surface is integrally formed with a fixing element and the peripheral edge of said plate is formed with a recess adapted to fit on said fixing element.

By fitting the fixing element of the resin-covered gasket in the recess of said plate, the resin-covered gasket can be mounted on the plate without using any adhesive agent.

According to the invention, the resin-covered gasket can be mounted on the plate without using any adhesive agent and the liquid-contacted portion of the resin-covered gasket is composed solely of the corrosion-resistant resin cover; therefore, it is possible to prevent the mixing of impurities into the liquid due to dissolution of the adhesive agent so as to avoid degradation of the quality of the treating liquid and it is also possible to prevent the lowering of the sealing property due to the corrosion and prevent degradation of the core resulting from long-term use, whereby the sealing property can be stably secured. Further, the operation for renewing the resin cover of the resin-covered gasket is very simple and maintenance can be improved.

In one embodiment of the invention, said fixing element comprises a pair of projections projecting from said core toward the liquid-noncontacted side, and a connecting portion connecting said projections and extending parallel with said core, said recess comprising recesses adapted to fit on said projections and a hole adapted to fit on said connecting portion.

In another embodiment of the invention, said fixing element may be provided with a dowel adapted to fit in a fitting hole formed in said recess.

In a further embodiment of the invention, said fixing element may be provided with a stop adapted to engage with the upper surface of the plate around said recess.

BEST MODE OF EMBODYING THE INVENTION

A plate type heat exchanger according to the present invention will now be described with reference to the drawings showing embodiments thereof.

Figure 1:
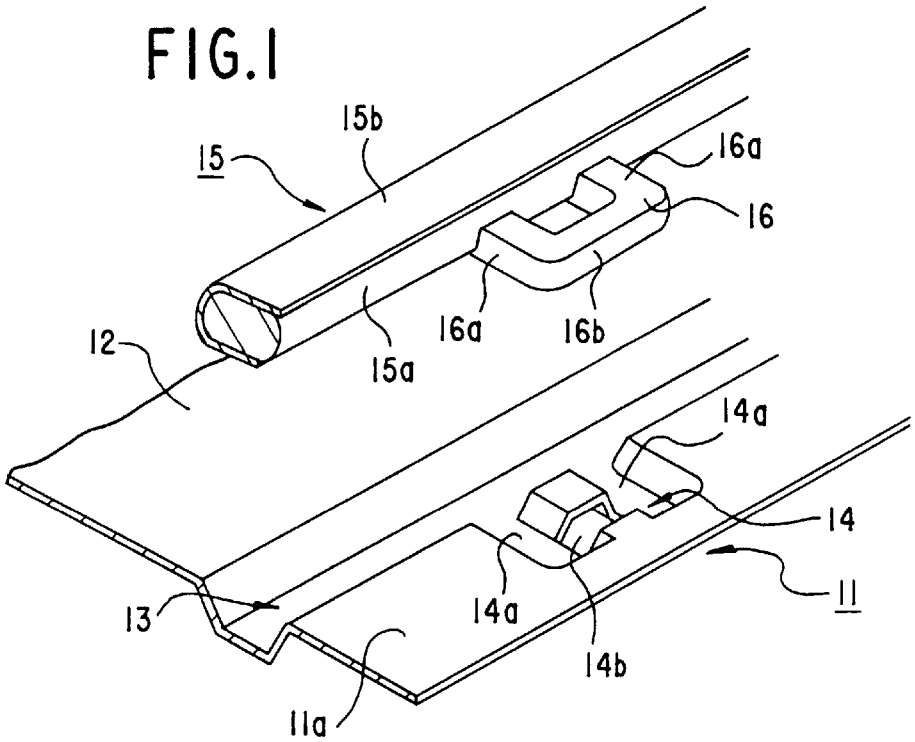
FIG. 1 is a partial perspective view of a plate and a resin-covered gasket in a plate type heat exchanger according to a first embodiment of the invention.
Figure 3:
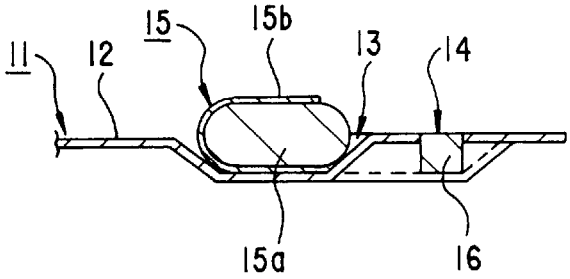
FIG. 3 is a sectional view taken along the line A—A in FIG. 2.
Figure 2:
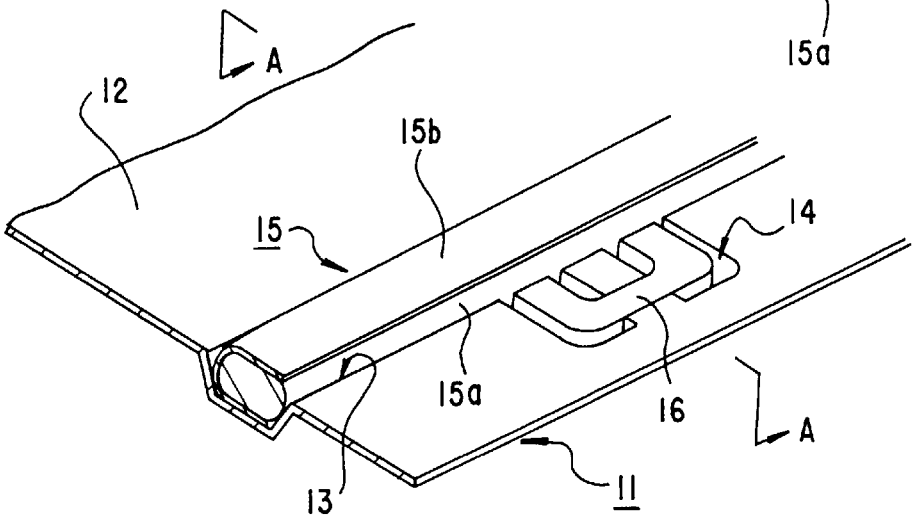
FIG. 2 is a partial perspective view of the resin-covered gasket mounted on the plate in the plate type heat exchanger according to the first embodiment of the invention.

FIGS. 1 through 3 show a first embodiment of the invention. FIG. 1 is a partial perspective view of a plate and a resin-covered gasket in a plate type heat exchanger according to the first embodiment of the invention; FIG. 2 is a partial perspective view of the resin-covered gasket mounted on the plate in the plate type heat exchanger according to the first embodiment of the invention; and FIG. 3 is a sectional view taken along the line A—A in FIG. 2.

As shown in FIG. 1, a plate 11 has a heat In transfer surface 12 formed with a suitable uneven pattern (not shown). The portion of the plate surrounding the heat transfer surface 12 is formed with a gasket groove 13. The peripheral edge 11*a* of the plate 11 is formed with U-shaped recesses 14 at predetermined intervals longitudinally of the gasket groove 13. A gasket 15 to be mounted in the groove 13 comprises an elastic core 15*a* of elastic material, such as synthetic rubber, and a corrosion-resistant resin cover 15*b* covering at least the liquid-contacted side (heat transfer side) of the core 15. The illustrated resin cover 15*b* is U-shaped in cross section and exposes the liquid-noncontacted side surface of the core 15. This liquid-noncontacted side surface of the core 15*a* is integrally formed with U-shaped fixing elements 16 corresponding to the recesses 14 in the plate 11. The resin-covered gasket 15, as shown in FIGS. 2 and 3, is mounted on the plate 11 by fitting in the gasket groove 13 the core 15 having its liquid-contacted side covered with the resin cover 15*b* and fitting the fixing elements 16 in the recesses 14 in the plate 11.

In this plate type heat exchanger of the first embodiment, the resin-covered gasket 15 can be mounted on the plate 11 without using any adhesive agent, such as a synthetic rubber type adhesive agent or viscous tape, in that the fixing elements 16 formed on the core 15*a* are fitted in the recesses 14 in the plate 11. Therefore, the liquid-contacted portion of the resin-covered gasket 15 consists solely of the corrosion-resistant resin cover, preventing impurities from entering the liquid and stably securing the sealing property. Furthermore, when the resin-covered gasket 15 is to have its resin cover renewed, it is no longer necessary to remove the adhesive agent adhering to the flat region of the gasket groove 13 as in the prior art; thus, the cover renewing operation for the gasket is very easy.

Further, as already described, the recess 14 and the fixing element 16 are both U-shaped and three-dimensionally fit together. That is, as shown in FIG. 1, the fixing element 16 comprises a pair of projections 16*a* projecting from the core 15*a*, and a connecting portion 16*b* connecting said projections and extending parallel with the core 15*a*, while the recess 14 comprises recesses 14*a* adapted to fit on the projections 16*a* of the fixing element 16, and a hole 14*b* adapted to fit on the connecting portion 16*b* of the fixing element 16. Because of such three-dimensional fitting arrangement, the joining strength between the gasket 15 and the plate 11 is high. Furthermore, the connecting portion 16*b* of the fixing element 16 is parallel with the core 15*a* and hence with the gasket groove 13 and is adapted to fit in the hole 14*b* in the form of a elongated slit hole which is likewise parallel with the gasket groove 13; therefore, some versatility is given to the fixing element 16 in the direction parallel with the gasket groove 13. As a result, even if there is a variation in the length of the cores 15*a*, such variation can be accommodated during the mounting of the gaskets by moving any fixing element 16 in the direction of the gasket groove 13.

Figure 4:
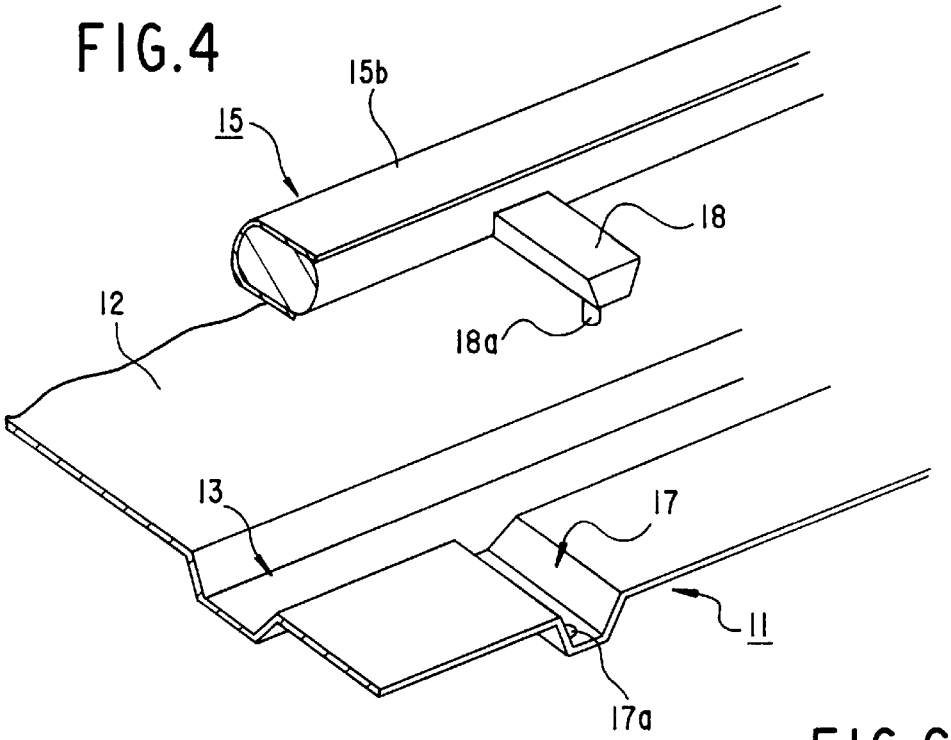
FIG. 4 is a partial perspective view of a plate and a resin-covered gasket in a plate type heat exchanger according to a second embodiment of the invention.
Figure 6:
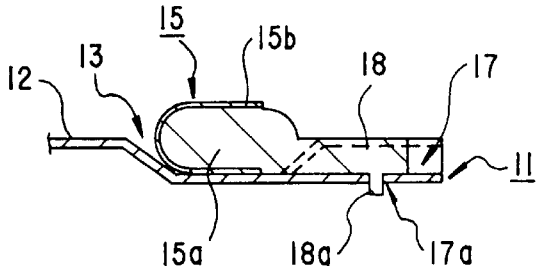
FIG. 6 is a sectional view taken along the line B—B in FIG. 5.
Figure 5:
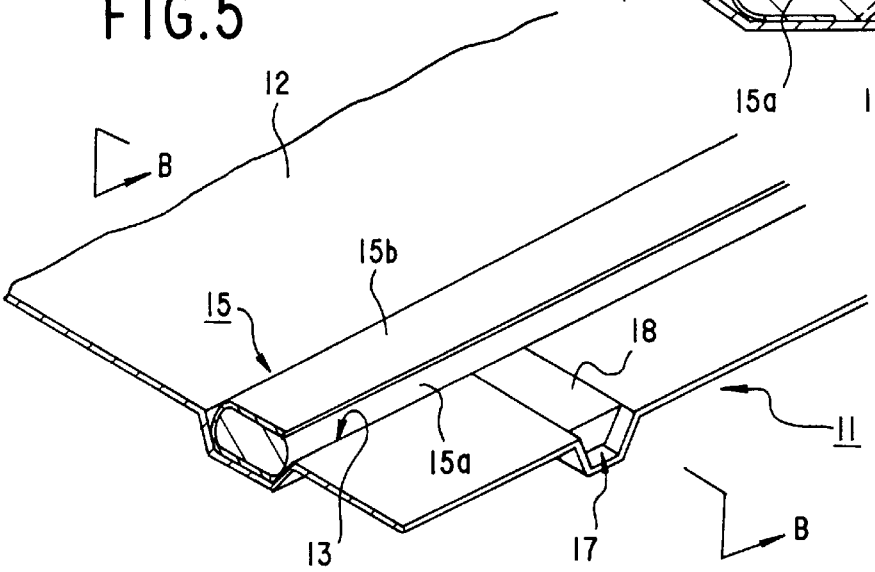
FIG. 5 is a partial perspective view of the resin-covered gasket mounted on the plate in the plate type heat exchanger according to the second embodiment of the invention.

FIGS. 4 through 6 show a second embodiment of the invention. FIG. 4 is a partial perspective view of a plate and a resin-covered gasket in a plate type heat exchanger according to the second embodiment of the invention; FIG. 5 is a partial perspective view of the resin-covered gasket mounted on the plate; and FIG. 6 is a sectional view taken along the line B—B in FIG. 5. The same parts as those shown in FIGS. 1 through 3 are marked with the same reference characters to omit a repetitive description thereof.

In the second embodiment, the outer peripheral edge 11*a* of the plate 11 is formed with a groove 17 and a fitting hole 17*a* is formed in the bottom surface of the groove 17, while the liquid-noncontacted side surface of resin-covered gasket 15 of the core 17*a* is integrally formed with a fixing element 18 associated with, and adapted to fit in, said groove 17, said fixing element 18 being integrally formed on its lower surface with a dowel 18*a* associated with and adapted to fit in said fitting hole 17*a*. As shown in FIGS. 5 and 6, it is arranged that at the same time as the fixing element 18 of the resin-covered gasket 15 is fitted in the groove 17 of the plate 11, the dowel 18*a* is fitted in the fitting hole 17*a*; thus, the resin-covered gasket 15 is mounted on the plate 11.

In this plate type heat exchanger of the second embodiment also, the resin-covered gasket 15 can be mounted on the plate 11 without using any adhesive agent, such as a synthetic rubber type adhesive agent or viscous tape. Therefore, the same functions and merits as in the first embodiment can be attained. Further, in each case, the fixing of the gasket can be effected by the fitting between the dowel 18*a* and the hole 17*a*, which are of simple shape and easy to process.

What has been described so far show the first and second embodiments of the invention, but the invention is not limited to these first and second embodiments. For example, as shown in FIGS. 7 through 20, modifications are possible within the scope of the invention.

Figure 7:
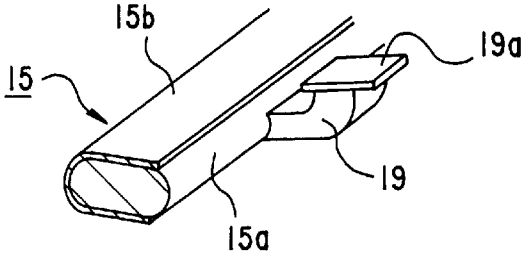
FIG. 7 is a partial perspective view of a resin-covered gasket in a plate type heat exchanger according to a third embodiment of the invention.
Figure 8:
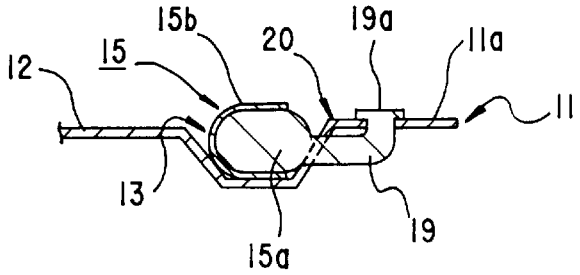
FIG. 8 is a sectional view showing the mounted state of the resin-covered gasket in the plate type heat exchanger according to the third embodiment of the invention.

FIGS. 7 and 8 show a third embodiment of the invention, wherein the liquid-noncontacted side surface of the core 15*a* of the resin-covered gasket 15 is integrally formed with a fixing element 19 having a stop 19*a* on the upper end, while the lateral wall on the liquid-noncontacted side of the gasket groove 13 of the plate 11 and the outer peripheral edge 11*a* which is an extension of said lateral wall are notched to form a slit hole 20 adapted to fit on the fixing element 19. And, as shown in FIG. 8, it is arranged that by fitting the fixing element 19 in the slit 20 until the stop 19*a* abuts against the outer peripheral edge 11*a* of the plate 11, the resin-covered gasket 15 is mounted on the plate 11. In this embodiment, the presence of the stop 19*a* ensures that the gasket is pushed in to a fixed depth. Therefore, the attaching operation is easy and, furthermore, the three-dimensional fitting provides a higher joining strength between the gasket and the plate.

Figure 9:
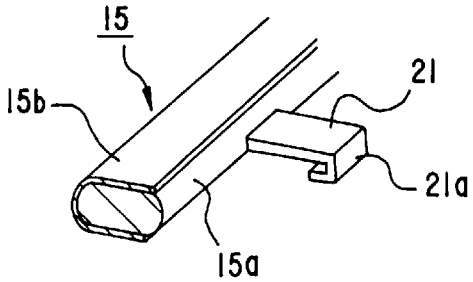
FIG. 9 is a partial perspective view of a resin-covered gasket in a plate type heat exchanger according to a fourth embodiment of the invention.
Figure 10:
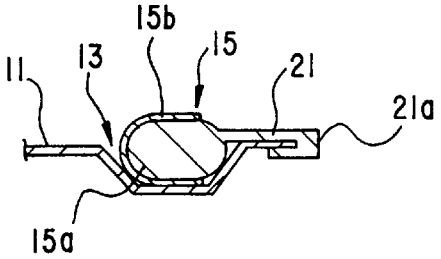
FIG. 10 is a sectional view showing the mounted state of the resin-covered gasket in the plate type heat exchanger according to the fourth embodiment of the invention.

FIGS. 9 and 10 show a fourth embodiment of the invention, wherein the liquid-noncontacted side surface of the core 15*a* of the resin-covered gasket 15 is integrally formed with a fixing element 21 having a U-shaped grip portion 21*a* at its front end for gripping the outer peripheral edge of the plate 11. As shown in FIG. 10, it is arranged that the grip portion 21*a* at the front end of the fixing element 21 of the resin-covered gasket 15 grips the outer peripheral edge of the plate 11, whereby the resin-covered gasket 15 is mounted on the plate 11.

Figure 11:
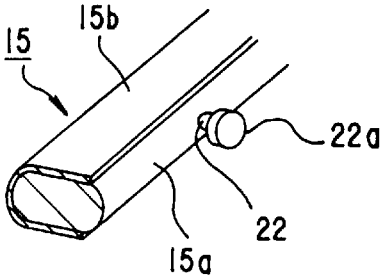
FIG. 11 is a partial perspective view of a resin-covered gasket in a plate type heat exchanger according to a fifth embodiment of the invention.
Figure 12:
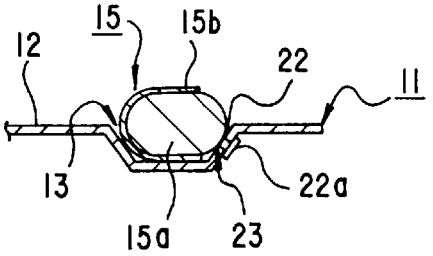
FIG. 12 is a sectional view showing the mounted state of the resin-covered gasket in the plate type heat exchanger according to the fifth embodiment of the invention.
Figure 13:
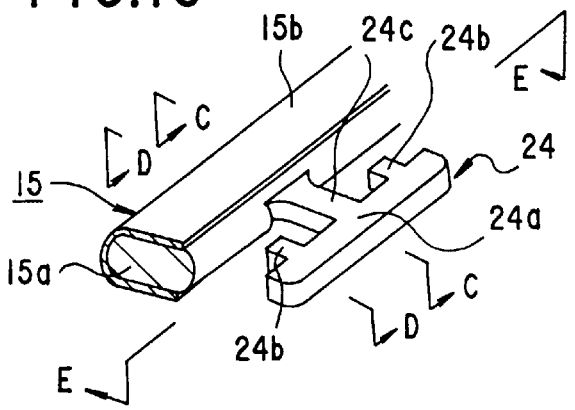
FIG. 13 is a partial perspective view of a resin-covered gasket in a plate type heat exchanger according to a sixth embodiment of the invention.

FIGS. 11 and 12 show a fifth embodiment of the invention, wherein the liquid-noncontacted side surface of the core 15*a* of the resin-covered gasket 15 is integrally formed with a fixing element 22 having an engaging flange 22*a* at its front end. As shown in FIG. 12, it is arranged that the engaging flange 22*a* at the front end of the fixing element 22 of the resin-covered gasket is fixedly fitted in a through-hole 23 formed in the outer peripheral edge 11*a* of the plate 11, whereby the resin-covered gasket 15 is mounted on the plate 11.

Figure 14:
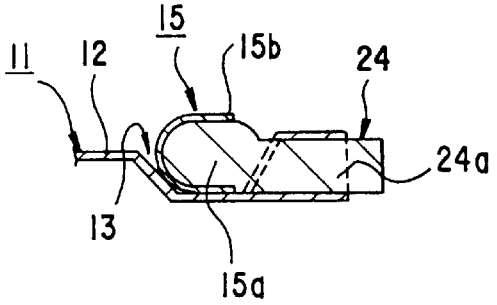
FIG. 14 is a sectional view taken along the line C—C in FIG. 13, showing the mounted state of the resin-covered gasket in the plate type heat exchanger according to the sixth embodiment of the invention.
Figure 15:
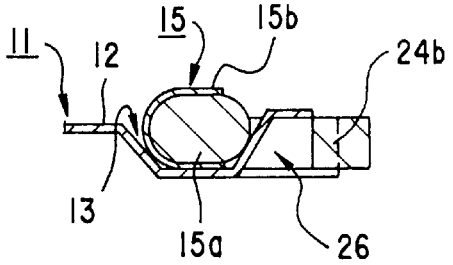
FIG. 15 is a sectional view taken along the line D—D in FIG. 13, showing the mounted state of the resin-covered gasket in the plate type heat exchanger according to the sixth embodiment of the invention.
Figure 16:
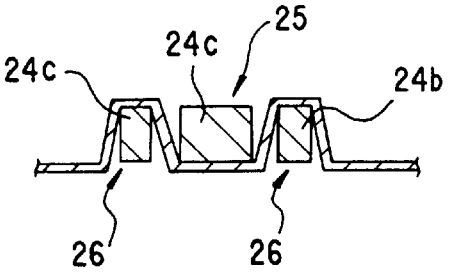
FIG. 16 is a sectional view taken along the line E—E in FIG. 13, showing the mounted state of the resin-covered gasket in the plate type heat exchanger according to the sixth embodiment of the invention.

FIGS. 13 through 16 show a sixth embodiment of the invention, wherein the liquid-noncontacted side surface of the core 15*a* of the resin-covered gasket 15 is integrally formed with a fixing element 22 which comprises a T-shaped fixing body 24*a* and projections 24*b* projecting from the opposite ends of the bar of the T which is parallel with the core 15*a*. As shown in FIGS. 14 and 16, it is arranged that the portion 24*c* perpendicular to the core 15*a* of the fixing body 24*a* of the fixing element 24 of the resin-covered gasket 15 is fitted in a groove 25 formed in the outer peripheral edge 11*a* of the plate 11, while as shown in FIGS. 15 and 16, the projections 24*b* on the fixing element 24 are fitted in fitting portions 26 formed in the outer peripheral edge of the plate 11 on the opposite sides of said groove 25, whereby the resin-covered gasket 15 is mounted on the plate 11.

Figure 17:
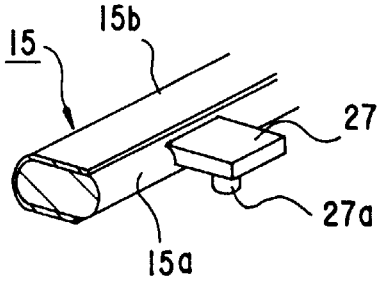
FIG. 17 is a partial perspective view of a resin-covered gasket in a plate type heat exchanger according to a seventh embodiment of the invention.
Figure 18:
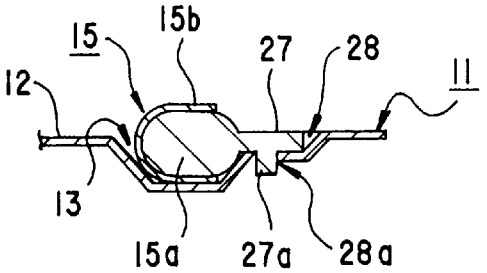
FIG. 18 is a sectional view showing the mounted state of the resin-covered gasket in the plate type heat exchanger according to the seventh embodiment of the invention.
Figure 19:
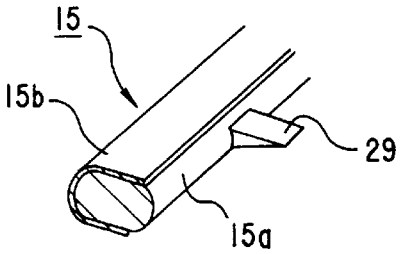
FIG. 19 is a partial perspective view of a resin-covered gasket in a plate type heat exchanger according to an eighth embodiment of the invention.

FIGS. 17 and 18 show a seventh embodiment of the invention, wherein the liquid-noncontacted side surface of the core 15*a* of the resin-covered gasket 15 is integrally formed with a fixing element 27 in the form of a flat plate, said fixing element 27 having a dowel 27*a* integrally projecting from the lower surface thereof. As shown in FIG. 18, it is arranged that at the same time as the fixing element 27 of the resin-covered gasket 15 is fitted in a recess 28 formed in the outer peripheral edge 11*a* of the plate 11, the dowel 27*a* is fitted in a fitting hole 28*a*, whereby the resin-covered gasket 15 is mounted on the plate 11.

Figure 20:
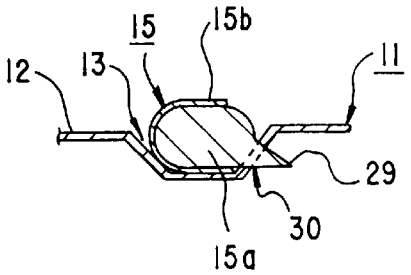
FIG. 20 is a sectional view showing the mounted state of the resin-covered gasket in the plate type heat exchanger according to the eighth embodiment of the invention.
Figure 21:
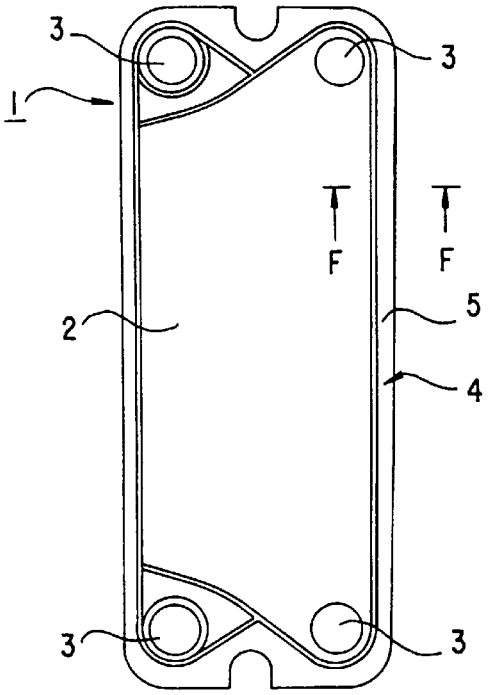
FIG.21 PRIOR ART
FIG. 21 is a front view of a plate constituting a plate type heat exchanger.
Figure 22:
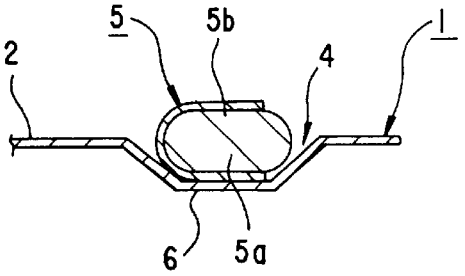
FIG.22 PRIOR ART
FIG. 22 is a sectional view taken along the line E—E in FIG. 21, showing the mounted state of a conventional resin-covered gasket.

FIGS. 1 and 20 show an eighth embodiment of the invention, wherein the outer peripheral edge 11*a* of the core 15*a* of the resin-covered gasket 15 is integrally formed with a fixing element 29 in the form of a tongue projecting therefrom. As shown in FIG. 20, it is arranged that the fixing element 29 of the core 15*a* of the resin-covered gasket 15 is fitted in an engaging hole 30 formed in the lateral surface opposite to the liquid-contacted side of the gasket groove 13 in the plate 11, whereby the resin-covered gasket 15 is mounted on the plate 11.

What is claimed is:

1. A plate type heat exchanger comprising:

a gasket; and a plurality of laminated plates each formed with a gasket groove surrounding a heat transfer surface with said gasket fitted therein, said gasket including a core of elastic material and a corrosion-resistant resin cover covering a side of a core surface which comes in contact with a liquid, wherein the opposite side, or liquid-noncontacted side, of said core surface is integrally formed with a fixing elements, a peripheral edge of said plate and a lateral wall on the liquid-noncontacted side of said gasket groove is formed with a slit hole to receive said fixing element and, wherein said fixing element is provided with a stop adapted to engage with an upper surface of the plate peripheral edge around said gasket groove.

* * * * *